US007186321B2

(12) United States Patent
Benham

(10) Patent No.: US 7,186,321 B2
(45) Date of Patent: Mar. 6, 2007

(54) CATHODIC PROTECTION SYSTEM FOR METALLIC STRUCTURES

(76) Inventor: Roger A. Benham, 4005 LaSalle St., San Diego, CA (US) 92110

( * ) Notice: Subject to any disclaimer, the term of this patent is extended or adjusted under 35 U.S.C. 154(b) by 450 days.

(21) Appl. No.: 10/729,996

(22) Filed: Dec. 9, 2003

(65) Prior Publication Data

US 2004/0112737 A1 Jun. 17, 2004

Related U.S. Application Data

(60) Provisional application No. 60/433,572, filed on Dec. 16, 2002.

(51) Int. Cl.
*C23F 13/02* (2006.01)

(52) U.S. Cl. ..... 204/196.36; 204/196.1; 204/196.11; 204/196.21; 204/196.26; 205/724; 205/730; 205/734; 29/722; 29/745; 29/746

(58) Field of Classification Search ..... 205/724, 205/730, 734; 204/196.1, 196.11, 196.21, 204/196.26, 196.36; 29/722, 745, 746
See application file for complete search history.

(56) References Cited

U.S. PATENT DOCUMENTS 3,959,664 A * 5/1976 Kosoegawa et al. ..... 307/95
5,415,745 A * 5/1995 Pultan et al. ..... 205/730
6,224,742 B1 * 5/2001 Doniguian ..... 205/724
6,315,876 B1 11/2001 Delahoyde et al. .... 204/196.06
6,346,188 B1 2/2002 Shuster et al. ..... 205/734
6,461,082 B1 10/2002 Smith ..... 405/211.1
6,471,851 B1 10/2002 Bennett ..... 205/730

FOREIGN PATENT DOCUMENTS

WO WO 91/11879 8/1991

* cited by examiner

*Primary Examiner*—Bruce F. Bell
(74) *Attorney, Agent, or Firm*—Hoffman, Wasson & Gitler, P.C.

(57) ABSTRACT

An active cathodic protection system, the apparatus comprising a rectifier element with at least one electrical connection to a source of electrical current, the rectifier element associated with a direct current positive (+) output terminal for electrical connection of via an anode connector to a consumable anode, a direct current negative (−) output terminal for electrical connection via a cathode connector to the structure to be protected, grounding means for electrical grounding of the apparatus and anti-cross connection means for preventing the continuing flow of electrical current when the anode connector is associated with the negative output terminal and the cathode connector is associated with the positive output terminal.

15 Claims, 8 Drawing Sheets

CATHODIC PROTECTION SYSTEM FOR METALLIC STRUCTURES

The present application is based upon U.S. provisional patent application No. 60/433,572, filed 16 Dec., 2002.

BACKGROUND OF THE INVENTION

1. Field of the Invention

The present invention relates to a method of corrosion control for buried piping, and in particular to an impressed current cathodic protection system for protection of isolated and electrically grounded buried or submerged metallic structures, an electrical means of anti-cross-connection, a means of cross-connection warning, a means of controlling DC voltage and current output on a cathodic protection system, a means of maintaining a low resistance ground-bed, and a means of anode and backfill installation and transport.

2. Discussion of Related Art

Cathodic protection is a widely used method of corrosion control for buried or submerged structures. Systems for the cathodic protection of buried or submerged structures are generally well known. Examples include U.S. Pat. Nos. 6,471,851, 6,461,082, 634,188, and 6,315,876.

There are two basic methods of cathodic protection, including the passive, or sacrificial anode system, and the active, or impressed-current system. Each type of system achieves the same purpose, to provide cathodic protection to a structure that is being protected.

Whether using an active or passive system, to achieve full protection often requires using dielectric insulators to electrically isolate the protected structure from other structures that are not intended to be protected. Electrical isolation of the protected structure allows the protective current to be contained within the desired circuit, and not "lost" to other buried or submerged structures that are not intended to be protected. Electrical isolation of the protected structure assists in achieving reasonable system life expectancy by keeping the anode-bed current at lower and more manageable levels. There are cases where full cathodic protection cannot be achieved without electrically isolating the structure to be protected.

With regard to the application of cathodic protection for buried piping associated with commercial or residential buildings, electrical isolation of the piping is practically impossible, and not legal in many cases. With typical building construction, the piping is buried below the concrete foundation and flooring slab, and projects upwardly through the concrete slab at numerous service locations within the building inside walls and concealed spaces, creating access problems and numerous potential areas for electrical contact, or "shorting", to the building grounding system. Therefore, an attempt to isolate below-slab metallic piping is usually not practical due to the many inaccessible locations that would require dielectric insulators.

Legally, in many if not all cases, it would be against building codes and regulations to electrically isolate piping within a commercial or residential building. This is due to safety issues related to the electrical grounding requirements, where the piping is grounded to provide a low resistance path to earth for the electric circuit-breakers to work. In other words, if the piping were not grounded it could be electrified with high voltage and the circuit-breaker would not pop open, until some conducting member or structure completed the circuit to ground. The conducting structure could be a living creature such as a human being and completion of the electrical circuit would generally lead to electrocution.

Therefore, there is a need to provide a cathodic protection system that is well suited to provide protection to buried piping systems that cannot be electrically isolated and that are electrically associated with the electrical grounding system of the utility company.

With the active, or sacrificial anode system, the electrical current is driven by the naturally occurring fixed voltage between the anode material (typically zinc or magnesium) and the structure to be protected (usually steel or copper). This fixed voltage limits the current output, especially in higher resistance soils, and often makes the active system an expensive and generally poor choice for protection of bare or poorly coated structures that are not able to be electrically isolated.

The active, impressed current system, described herein may provide a useful alternative to the application of cathodic protection for buried or submerged structures that are shorted to the electrical grounding systems, particularly piping systems typically found on commercial or residential buildings. (Such an impressed current DC power supply unit is herein referred to as a cathodic protection rectifier, or, more simply a "rectifier". The power supply unit may also be connected to an alternating current AC supply and thus a transformer may be provided to convert the AC into DC).

The cathodic protection system described here may provide a system with inherent safety features to guard against cross-connecting the structure and the anode-bed. In the cathodic protection installation and service industry, a cross-connection of the output leads is a very serious and real concern. In a cross-connection incident, an operator accidentally connects the cathodic protection rectifier output wires in the wrong positions, connecting the anode lead to the negative (−) terminal and the structure lead to the positive (+) terminal. This results in the structure being oxidized at an accelerated rate, and the consumable anode(s) being protected; the exact opposite of what is trying to be accomplished with a typically expensive cathodic protection system. This is especially bad if the structure that is damaged transports or stores flammable gas or petroleum oil.

A method of DC voltage control and regulation is described which is highly suitable for protection of piping in residential and commercial buildings. A method of maintaining a lower resistance anode bed is described. Also, a method of anode and backfill installation and transport is described that makes cathodic protection a more practical alternative to ongoing corrosion problems.

The present invention is designed to be easier to install, easier to service, more reliable, safer, more versatile in application (able to protect various grounded piping systems), and lends itself to do-it-yourself installers. The safety and transport aspects are particularly important for a reduction in cost to the consumer.

BRIEF SUMMARY OF THE DISCLOSURE

The present invention is directed to an improved cathodic protection system, which may at least partially overcome the abovementioned disadvantages or provide the consumer with a useful or commercial choice.

In a broad form, the invention resides in an active cathodic protection system, the apparatus comprising a rectifier element with at least one electrical connection to a source of electrical current, the transformer and rectifier element associated with a direct current positive (+) output terminal for electrical connection of via an anode connector to a consumable anode, a direct current negative (−) output terminal for electrical connection via a cathode connector to the structure to be protected, grounding means for electrical grounding of the apparatus and anti-cross connection means for preventing the continuing flow of electrical current when the anode connector is associated with the negative output terminal and the cathode connector is associated with the positive output terminal. The situation where the anode connector is associated with the negative output terminal and the cathode connector is associated with the positive output terminal is preferably known as cross-connection.

It is preferred that at least one, and preferably both of the anode connector and the cathode connector are conductor wires, leads or the like.

In this form the invention resides in an improved cathodic protection system, which has safety feature that prevents the catastrophic consequences of cross-connecting the anode-bed and structure wiring at the rectifier panel. The anode may suitably be located buried in the ground. The anode may preferably take the form of an anode bed.

It is important to note that the cross-connection of cathodic protection rectifier systems may also be threatened by vandals and saboteurs that could intentionally cross-connect a system to cause severe damage to piping and structures.

In a preferred form, the means for preventing the continuing flow of electrical current in the cross-connection situation may be a fuse or the like. Such a fuse may preferably be located between the transformer and the negative output terminal thereof. The fuse may preferably be associated with the direct current side of the transformer and rectifier element. There may suitably also be a fuse associated with the alternating current side of the transformer and rectifier element.

The fuse may typically be associated with a warning lamp or light connected in parallel with the fuse, whereby if the fuse blows, the warning lamp is lit to notify users or operators of the system that cross-connection has occurred. The fuse may suitably blow and cause the output voltage to occur across a high resistance, low current consumption light, such as a small Light Emitting Diode (LED). This LED may provide the installer with an immediate indication that there is a problem, namely, that the fuse has blown. A continuously failing fuse may indicate to the installer that there would be a problem.

In a particularly preferred form of the present invention, in the event of a cross-connection on an electrically grounded structure, the internal circuitry may cause the fuse on the panel of the rectifier to blow, immediately shutting down the system. In the event of a cross-connection, electrical current will not be allowed to flow continually due to the internal circuitry that may create a direct short-circuit within the cathodic protection unit.

The means for preventing the continuing flow of electrical current may further comprise a ground loop. The ground loop may comprise an electrical loop between a point in the internal wiring close to the negative output terminal near the warning lamp or light, the means for grounding the system and the external cathode connector/conductor lead, where with the addition of a specific internal jumper wire, in a cross-connection situation, both basic output terminals of the transformer and rectifier element are connected to the same means for grounding the system, resulting in a dead short.

The internal circuity may create a dead short in the event of a cross-connection by means of the low resistance path through what we define as the "ground loop resistance", that is, the path along the cross-connected external negative "pipe" lead (which is incorrectly attached to the positive terminal) to the building electrical grounding network, back to the rectifier through the electrical supply grounding wire, through the additional "jumper" connection, then to the negative output of the rectifier. In other words, in the event of a cross-connection, both output leads of the rectifier become shorted through the low resistance electrical grounding system, and the DC fuse of the rectifier blows. In the event an inexperienced operator or service technician does not realize their mistake, no matter how many times they try to get the system to output current, the internal circuitry may not allow it. Also, a saboteur or vandal may not succeed in impressing current in the "wrong" direction.

In a particularly preferred embodiment, the electrical grounding means and/or the portion of the system between the rectifier element and the consumable anode may have a low resistance.

The means for preventing the continuing flow of electrical current may also be or comprise a current directing diode. The current directing diode may preferably be associated with the cathode connector/conductor wire. Alternatively, the current directing diode may be associated with the anode connector/conductor wire.

In this preferred form of the invention, in the event of a cross-connection on an electrically grounded structure, a current directing diode in a junction box, which may suitably be either buried, at ground level, or above ground level, may be installed on the electrical connection between the structure to be protected and the negative output terminal of the transformer and rectifier element to prevent current from going in the wrong direction. It should be noted that the current directing diode may also be installed on the positive anode wire preventing current from going the wrong direction in the event of a cross-connection. In either case, if the leads were accidentally, or intentionally switched, no current would be allowed to flow.

Another aspect of this invention is a cathodic protection system comprising a cathodic protection system body, and a remotely installed plug-in type power supply module designs similar to those common for electronic devices. In a preferred embodiment the cathodic protection system body may be an injection molded case with all of the electrical components attached, such as Alternating Current (AC), Direct Current (DC), and grounding wiring terminals, fuses, warning lights, "on" lights, "system ok" lights, telephone monitoring jack, potentiometer trimming switch, rotating selector switch, circuit boards, LCD displays, and integrated circuit components. The type of plug-in power supply may be a single voltage, switchable voltage type, or a constant current type of plug-in module that automatically sets the voltage to a predetermined current output. A trimming potentiometer, or external resistor jumper terminals, may preferably be installed in the cathodic protection system body for additional current and voltage output adjustment. An internal multimeter capability with a function selector switch could be incorporated to allow direct readings of voltage output, current output, and circuit resistance, on a LCD or LED display. A menu system could be incorporated into the function selector switch provide troubleshooting, diagnostics, or user and operator education.

Typical cathodic protection rectifiers use expensive multi-tap transformers or variable voltage transformers that are wired to a step-down transformer. In addition to being expensive, this type of cathodic protection rectifier is very heavy and cumbersome, due to the extensive copper windings and cooling requirements. These types of conventional rectifiers are good for the traditional outdoor pipeline applications, but are overkill and unsuitable for installations in residential and commercial buildings where hundreds of smaller systems would be installed on a one per homeowner unit basis.

Often, in drier climates, anode beds installed in the earth tend to dry-out causing high resistance in the circuit. The anode bed may preferably be regularly moistened by installing a drip-irrigation system to regularly dispense water on top of the anode bed installation. This may suitably be accomplished by either tapping into the existing irrigation system piping, which is plentiful at most commercial and residential properties in drier areas of the country, or, a water bottle with a dripping tube can be installed in a "valve-box" directly above the anode installation.

Another aspect of the installation of cathodic protection on electrically grounded structures in commercial and residential buildings is the need to distribute current over a large area by installing numerous rectifier and anode systems. Some projects which have experienced ongoing below-slab copper corrosion have required several dozen rectifier/anode installations throughout a maze of buildings. In these cases, the traditional method of installing anodes and backfill throughout the complex has created difficulty.

According to another aspect, the invention resides in a method of installing and transporting an anode and backfill materials comprising providing a container for holding a predetermined amount of backfill material for a particular anode hole size with the anode attached to the container, digging an anode hole corresponding to the amount of backfill material provided, placing the anode in the hole and placing the backfill material in the hole. This invention includes the formation of a container capable of assisting cleanly and efficiently transporting and installing the anode and backfill material. The preferred embodiment of the invention is a container with a screw-cap on one end. The container holds a quantity of backfill predetermined by the engineer or designer, typically a powdered or granular coke-breeze carbon graphite material, and/or a powdered gypsum bentonite material. This container may be reused over and over again, with a deposit or core charge arrangement with the customer, which would conserve resources and be beneficial to the environment not having to constantly throw away the packaging material.

A preferred type of anode material that can be attached to the reusable container is known as a "wire" anode. This material is usually made of a non-consumable substrate such as titanium or niobium, and a conductive consumable coating such as platinum, or what is known as a mixed-metal-oxide (MMO) anode. This type of anode material may be attached to the reusable container to make one complete anode bed installation material solution.

Also, because of the varied earth-grounding characteristics, in terms of soil-resistivity and conductivity, many different anode ground bed configurations may be required. There is no one anode size that is ideal and what may work at one location may not work at another. Therefore, the method of installing and transporting the anode material facilitates custom anode designs that are quick and easy to use for the customer.

The above mentioned container preferably includes a rigid tube with a removable endcap that is made in a'predetermined size to provide the exact amount of backfill that is required for the specified anode and hole size configuration. The rigid tube may incorporate a handle and a strapping mechanism to attach the backfill and the corresponding anode together for improved handling, transport and installation. This configuration may provide for a more effective means for managing the anode and backfill materials on the job site. Also, this packaging method may enable a lessor experienced contractor or do-to-yourself installer, who may not have the ability to determine anode and backfill size and quantity requirements, to install cathodic protection on their own without the assistance of an experienced installer. Also, this packaging method lends itself well to easier shipping and direct mail delivery to the customer.

BRIEF DESCRIPTION OF THE DRAWINGS

FIG. 4 shows an incorrectly wired impressed-current cathodic protection rectifier system installed to protected electrically grounded piping, such as in a building, with a preferred embodiment of an internal protection circuitry causing internal fuse to blow, and the cross-connection warning light to turn on.

DETAILED DESCRIPTION

With reference to FIGS. 1 through 8, the cathodic protection system is there illustrated which exemplifies the present invention. The system as shown comprises a DC power supply rectifier, a consumable anode installed in the earth, associated wiring, and the protected piping.

Figure 1:
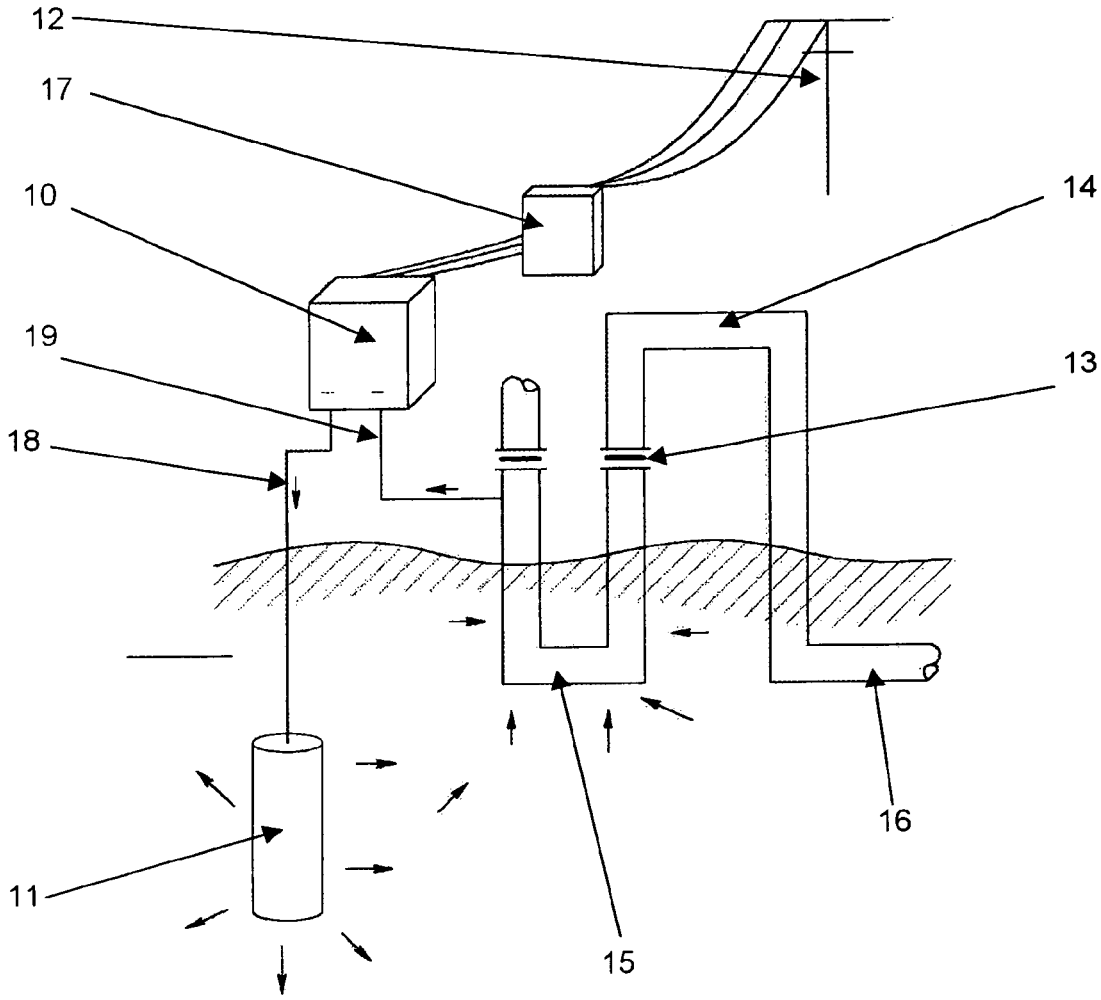
FIG. 1 shows a typical impressed current cathodic protection system that incorporates dielectric insulators to direct current only to protected section of pipe.

FIG. 1 shows the typical active, or impressed current cathodic protection system installation, including the DC power supply rectifier 10, the consumable anode-bed 11, associated wiring, AC power source 12, and dielectric insulators 13 to limit electrical current to the intended structure to be protected. The arrows show the direction of the electrical current. The electrical current causes oxidation at the surface of the anode 11 and reduction at the surface of the structure to be protected 14, which is made the cathode in the circuit. The electrical current is contained in the circuit and to the protected section 15 of the structure and is not permitted to impress upon the unprotected section 16 of the structure on the other side of the dielectric insulators.

The structure to be protected 14 is connected to the rectifier 10 via a cathode connector/conductor wire 19 and the anode 11 is connected to the rectifier 10 via an anode connector/conductor wire 18.

There is also shown a conventional meter and circuit breaker box 17 to disrupt flow of incoming electrical current in the event of a supply problem.

Figure 2:
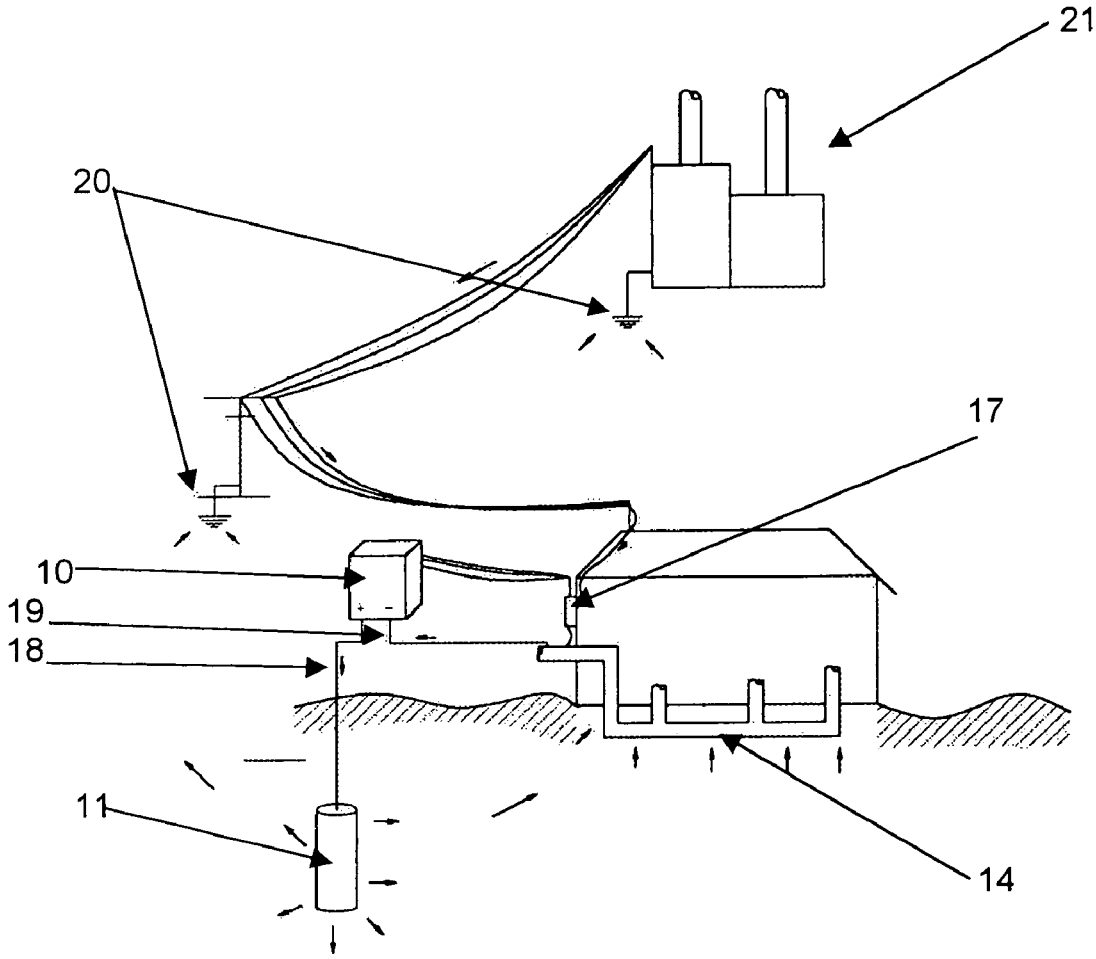
FIG. 2 shows a cathodic protection installation on a building with below-slab grounded piping that is electrically bonded to the utility grounding system and showing the electric current is only partially directed to below-slab piping.

FIG. 2 shows the same circuit as shown in FIG. 1, except without the dielectric insulators 13, and the structure is electrically bonded to the grounding network 20 of the local utility company 21. In this case, electrical current is not isolated only to the structure that is being protected 14, but takes the path of least resistance including to local utility company's grounding network 20. The return path for the DC current back from the utility companies grounding network 20 is through the continuous ground and neutral wires in the AC power distribution system wiring.

Figure 3:
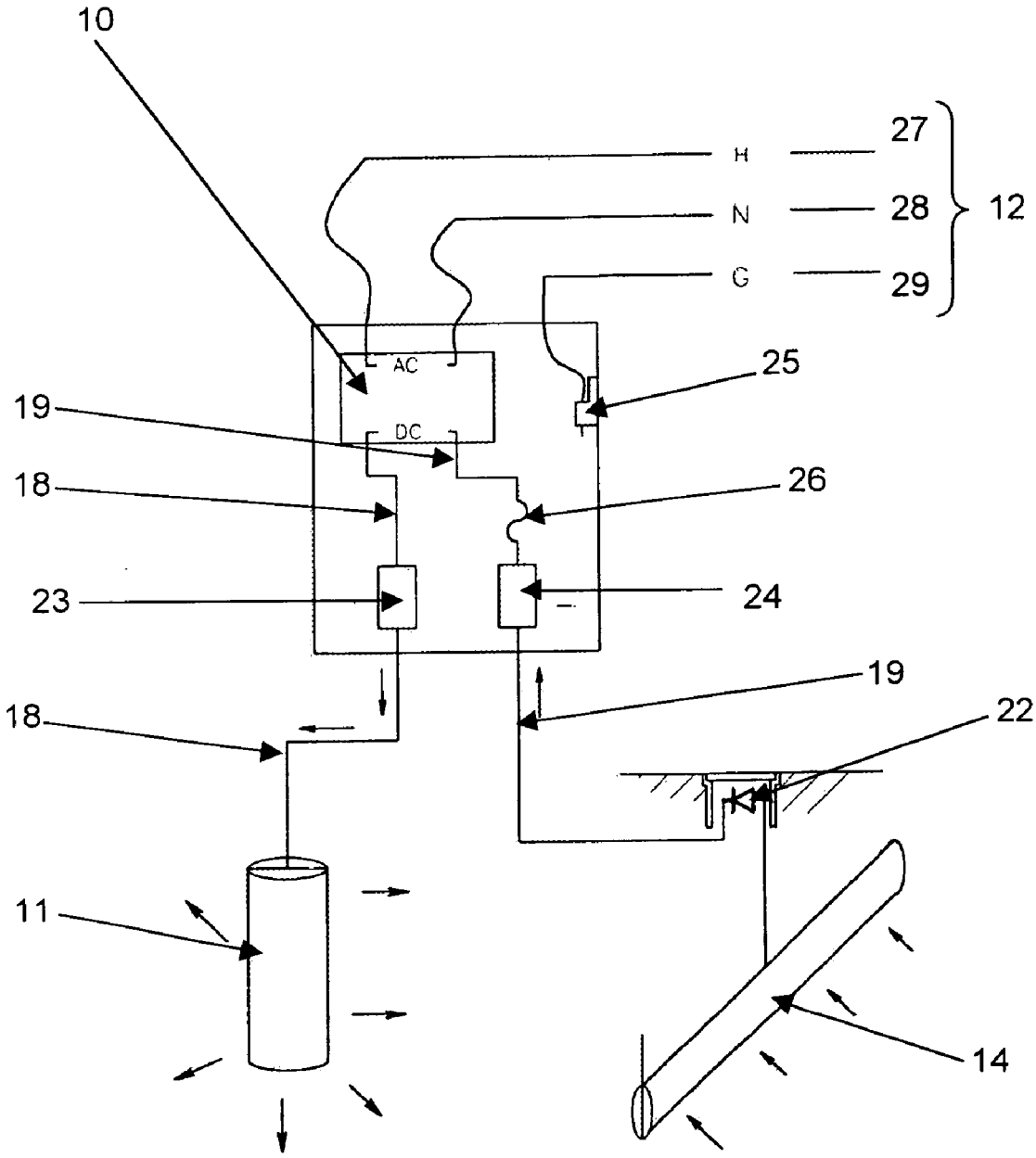
FIG. 3 shows a correctly wired impressed current cathodic protection rectifier system. The drawing shows a preferred embodiment of an installation of the invention in the form of a diode installed in an at grade junction box remote from the rectifier box. This diode would prevent electrical current from flowing if the leads were switched at the rectifier.

FIG. 3 shows a cathodic protection rectifier circuit that is correctly wired according to one aspect of the present invention.

The apparatus comprises a transformer and rectifier element 10 with an alternating current electrical connection to a source of electrical current 12, a direct current positive output terminal 23 for electrical connection via an anode connector/conductor wire 18 to a consumable anode 11, a direct current negative output terminal 24 for electrical connection via a cathode connector/conductor wire 19 to the structure to be protected 14, means for electrical grounding of the apparatus 25 and means 26, 32 for preventing the continuing flow of electrical current when the anode connector/conductor wire is associated with the negative output terminal and the cathode connector/conductor wire is associated with the positive output terminal.

The AC power source is generally a three wire system having a "hot" wire 27 through which AC voltage is provided, a neutral wire 28 and a ground wire 29. The means for grounding the invention is a direct connection to the ground wire of the AC power source 25, 29.

FIG. 3 shows an installation of an anti-cross connection invention in the form of a current directing diode 22 installed in a junction box remote from the rectifier 10 box. This diode would prevent electrical current from flowing if the leads were switched at the output terminals 23, 24.

Figure 4:
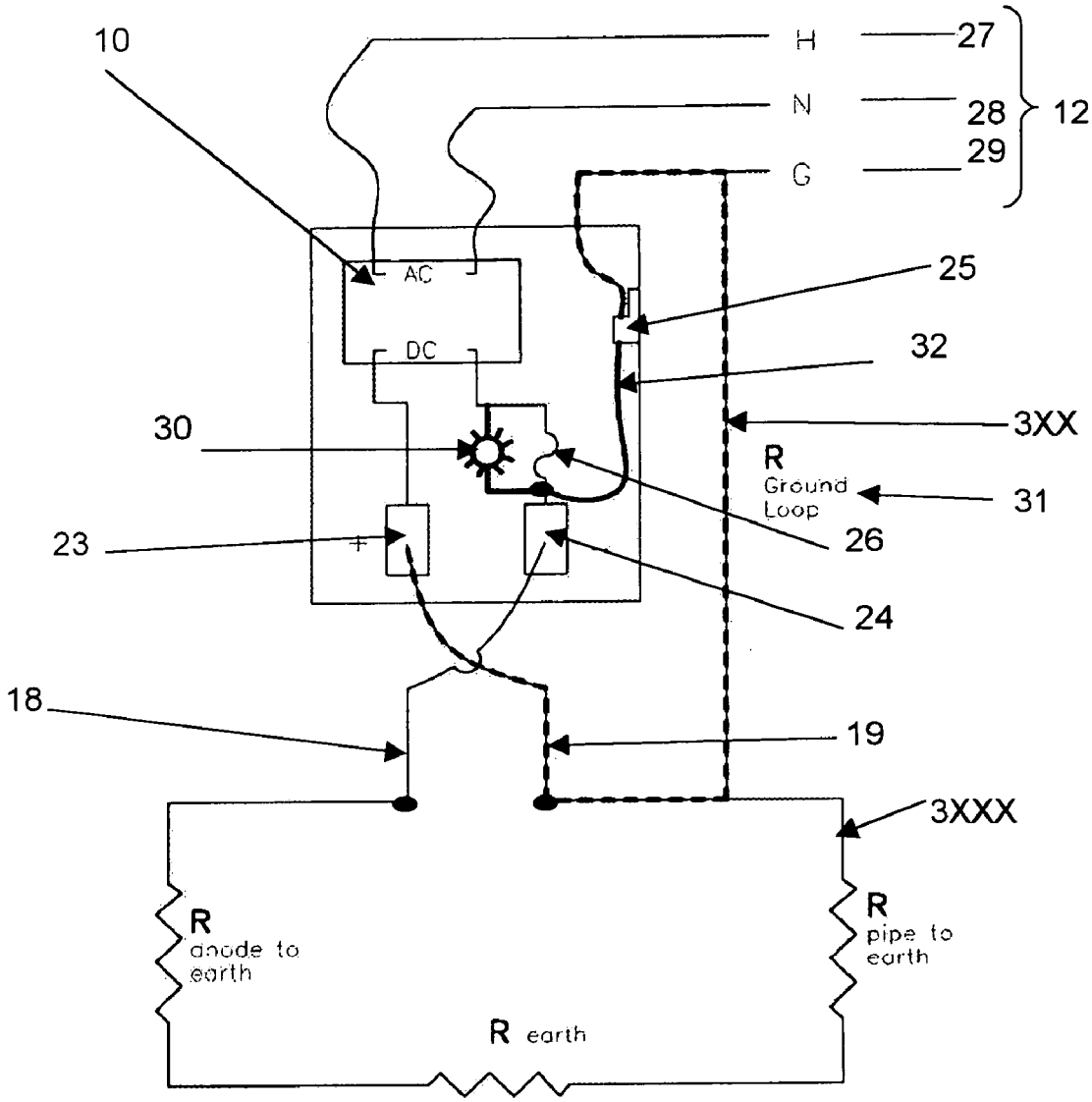

According to the aspect of the invention illustrated in FIG. 4, the means for preventing the continuing flow of electrical current in the cross-connection situation includes a fuse 26 or the like. The fuse 26 is located between the rectifier element 10 and the negative output terminal 24 thereof, on the direct current side of the transformer and rectifier element 10.

FIG. 4 shows a cathodic protection rectifier system that is cross-connected where the anode (+) and pipe (−) leads are accidentally, or maliciously, wired incorrectly.

The fuse 26 is associated with a warning lamp or light 30 connected in parallel with the fuse 26, so that if the fuse 26 blows, the warning lamp 30 is lit to notify users or operators of the system that cross-connection has occurred. The warning lamp would also light if the fuse blew for any other reason.

The means for preventing the continuing flow of electrical current further comprises a ground loop as shown in FIG. 4. The ground loop comprises a low resistance electrical loop 31 between the conductive region between the negative (−) output terminal 24 and the fuse 26, the jumper wire 32, the grounding means for grounding the system 25, the ground wire in the 3-wire AC power source 29, the grounding system in the building including the piping that is being cathodically protected 3XX, 3XXX, and the cathode connector/conductor wire 19, which is in a cross-connection situation being incorrectly connected to the anode (+) output terminal 23. Therefore, in a cross-connection situation both output terminals 23, 24 of the transformer and rectifier element 10 are connected to the means for grounding the system 25.

This internal circuity creates a dead short in the event of a cross-connection by means of the low resistance path through the "ground loop resistance", that is, from the positive output terminal 23, to the path along the negative connector/conductor wire 19, to the electrically grounded pipe 3XXX, to the building electrical grounding network, 3XX, 29, 25, and then through the electrical supply grounding terminal 32, through the jumper wire 32, then to the negative output terminal 24 of the rectifier. In other words, when cathdodically protecting a piping system in a building, in the event of a cross-connection, both output terminals 23, 24 of the rectifier 10 would be connected to the low resistance electrical grounding system 29, and the DC fuse 26 of the rectifier unit 10 blows. In the event an inexperienced operator or service technician does not realize their mistake, no matter how many times they try to get the system to output current, the internal circuitry will not allow it. Also, a saboteur or vandal may not succeed in impressing current in the "wrong" direction.

With the addition of the jumper wire 32 grounding the negative DC output 24 of cathodic protection rectifier 10 to the electrical ground within the rectifier 10 itself, hidden under the face plate, the cross-connected wiring results in a dead-short to through the grounding loop 31, causing the DC fuse 26 to blow and the warning light 30 to come on. It should be noted that this circuitry could not be used on cathodic protection systems that use dielectric insulators 13 to isolate the protected structure 14 from the electrical ground, for the added circuit 32 would short the structure to ground and render the dielectric insulators 13 ineffective. The addition of the circuitry described above is only for electrically grounded structures, such as found in buildings.

Figure 5:
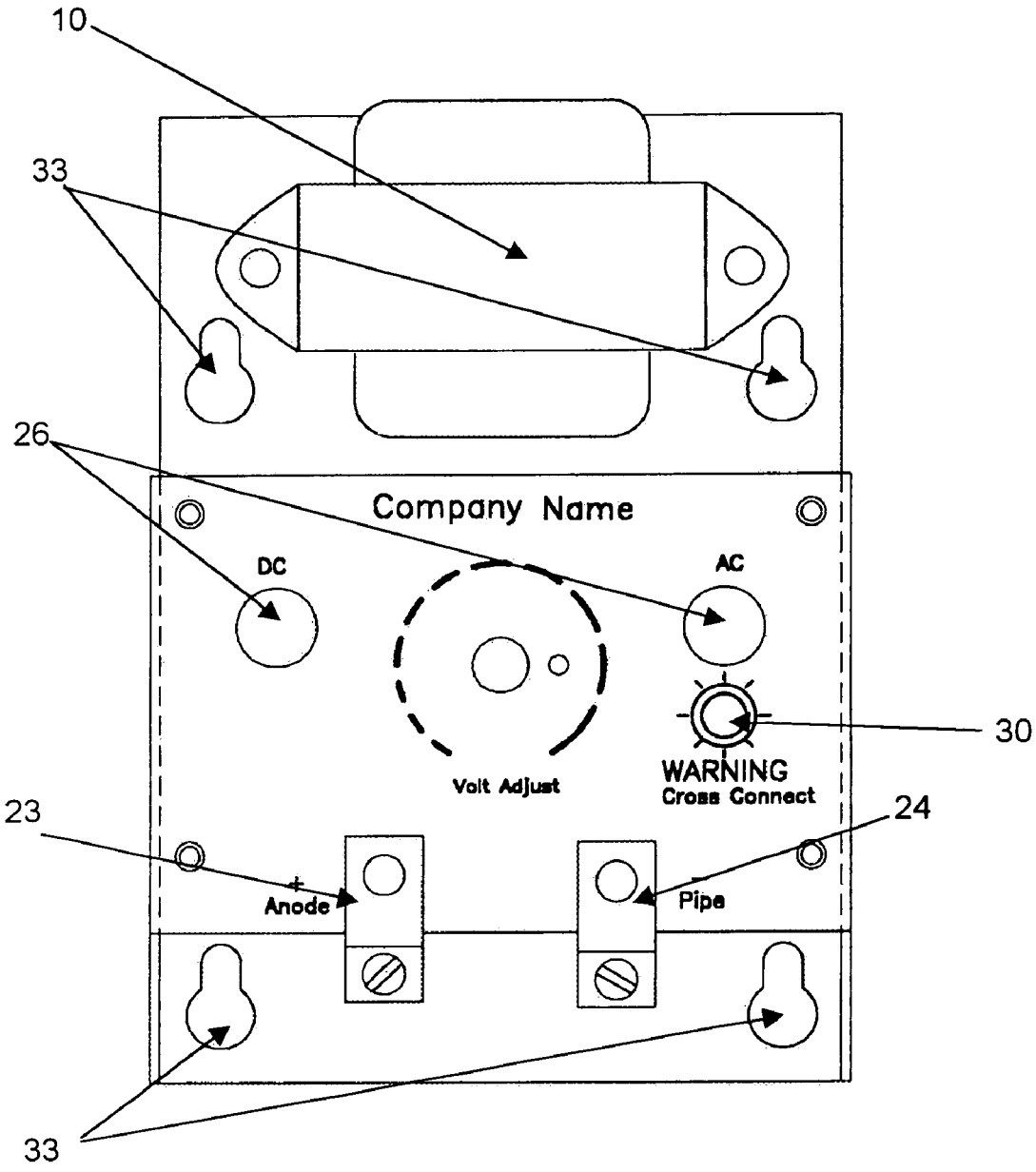
FIG. 5 shows an example of a preferred arrangement of the appearance of the faceplate and mounting means of improved cathodic protection system for electrically grounded piping with internal cross-connect circuitry and warning light according to a particularly preferred embodiment of the invention.

FIG. 5 shows the appearance of a faceplate and mounting means 33 of improved cathodic protection system for electrically grounded piping with internal cross-connect circuitry and warning light 30 according to a preferred embodiment of the invention.

Figure 6:
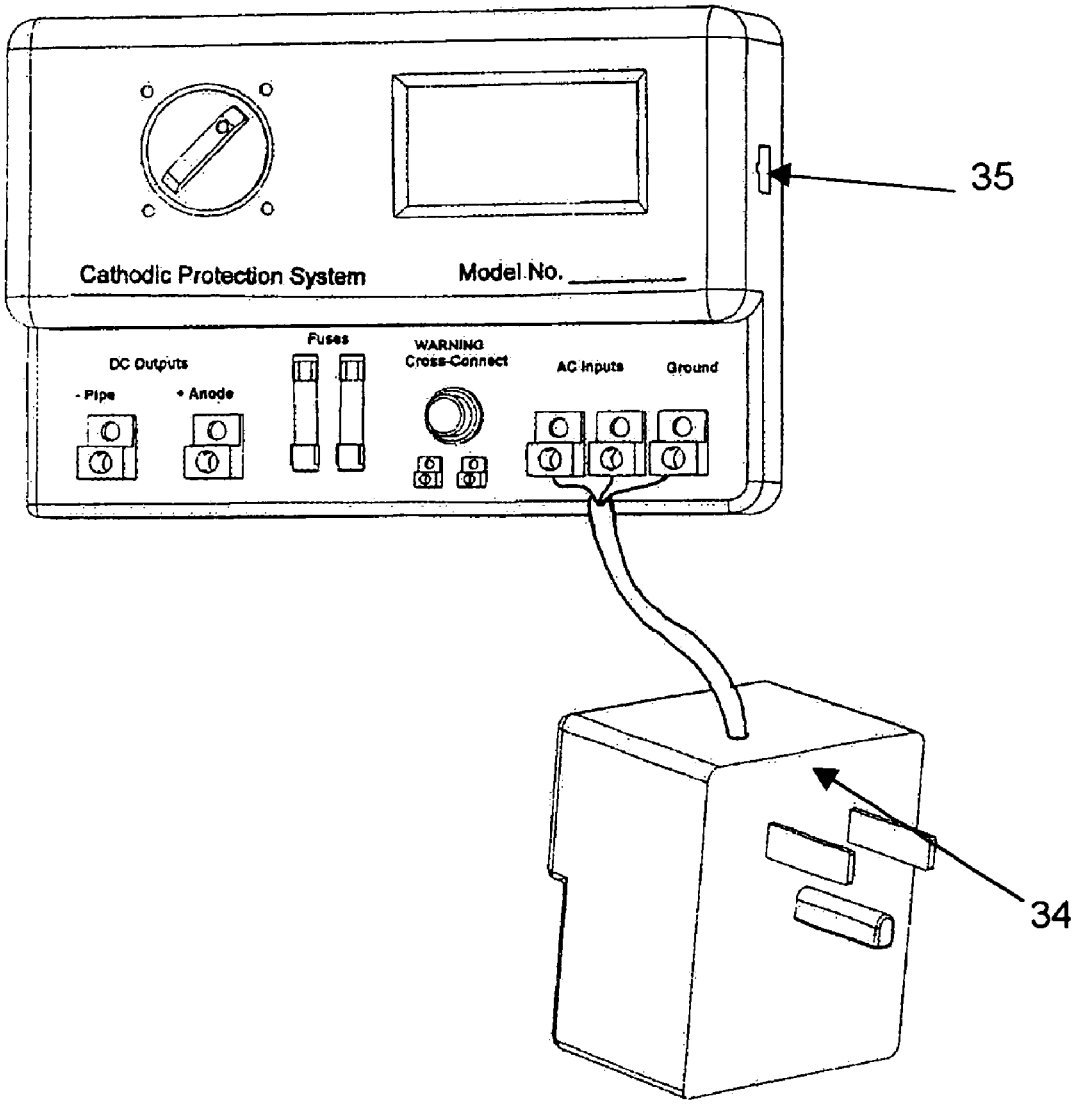
FIG. 6 shows appearance of improved cathodic protection system for electrically grounded piping with an injection molded plastic case, internal cross-connect circuitry, and warning light. This drawing also shows of the use of the present invention with an external plug-in power supply.

FIG. 6 shows a cathodic protection system that incorporates a remote AC to DC transformer 10 that allows the DC voltage and DC current output of the system to be changed by specifying or changing out a different plug-in voltage transformer 34. Also, a constant DC current automatic voltage transformer can be incorporated. The system is also shown with a telephone jack 35 for remote monitoring of the system status and output parameters. The cathodic protection system body is an injection molded case with all of the electrical components attached, such as Alternating Current (AC), Direct Current (DC), and grounding wiring terminals, fuses, warning lights, "on" lights, "system ok" lights, telephone monitoring jack, potentiometer trimming switch, rotating selector switch, circuit boards, LCD displays, and integrated circuit components.

Figure 7:
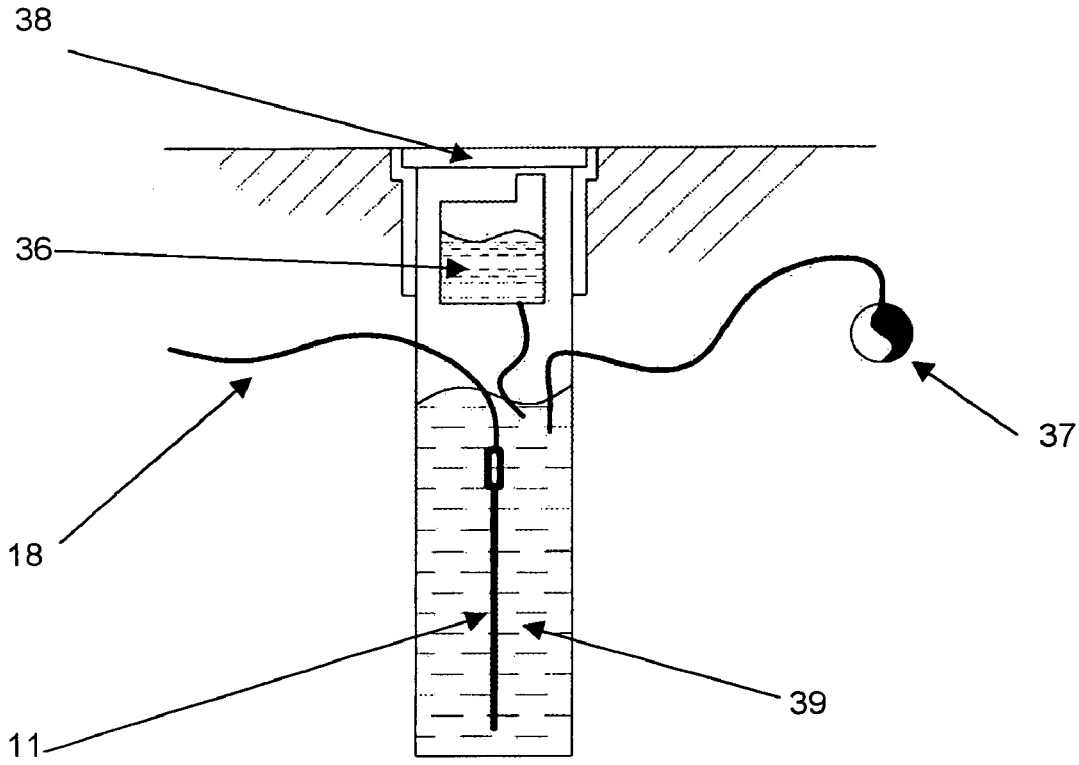
FIG. 7 shows a refillable water container preferably with higher-conductivity electrolyte mixture, and a drip irrigation bubbler tapped into the landscape irrigation system used to help maintain a lower anode-to-earth resistance by keeping the anode bed moist or wet in dry climates.

FIG. 7 shows two versions of drip watering system used to help maintain a lower anode-to-earth resistance by keeping the anode bed moist or wet in dry climates. First, a refillable water container 36 preferably with higher-conductivity electrolyte mixture, and second, a drip irrigation bubbler 37 tapped into the landscape irrigation system. Each type of system for drip watering the anode bed could be used independently. An access cover 38 is also provided. The anode is surrounded in the hole by a ground contact backfill material 39 such as graphite, bentonite or the like.

Figure 8:
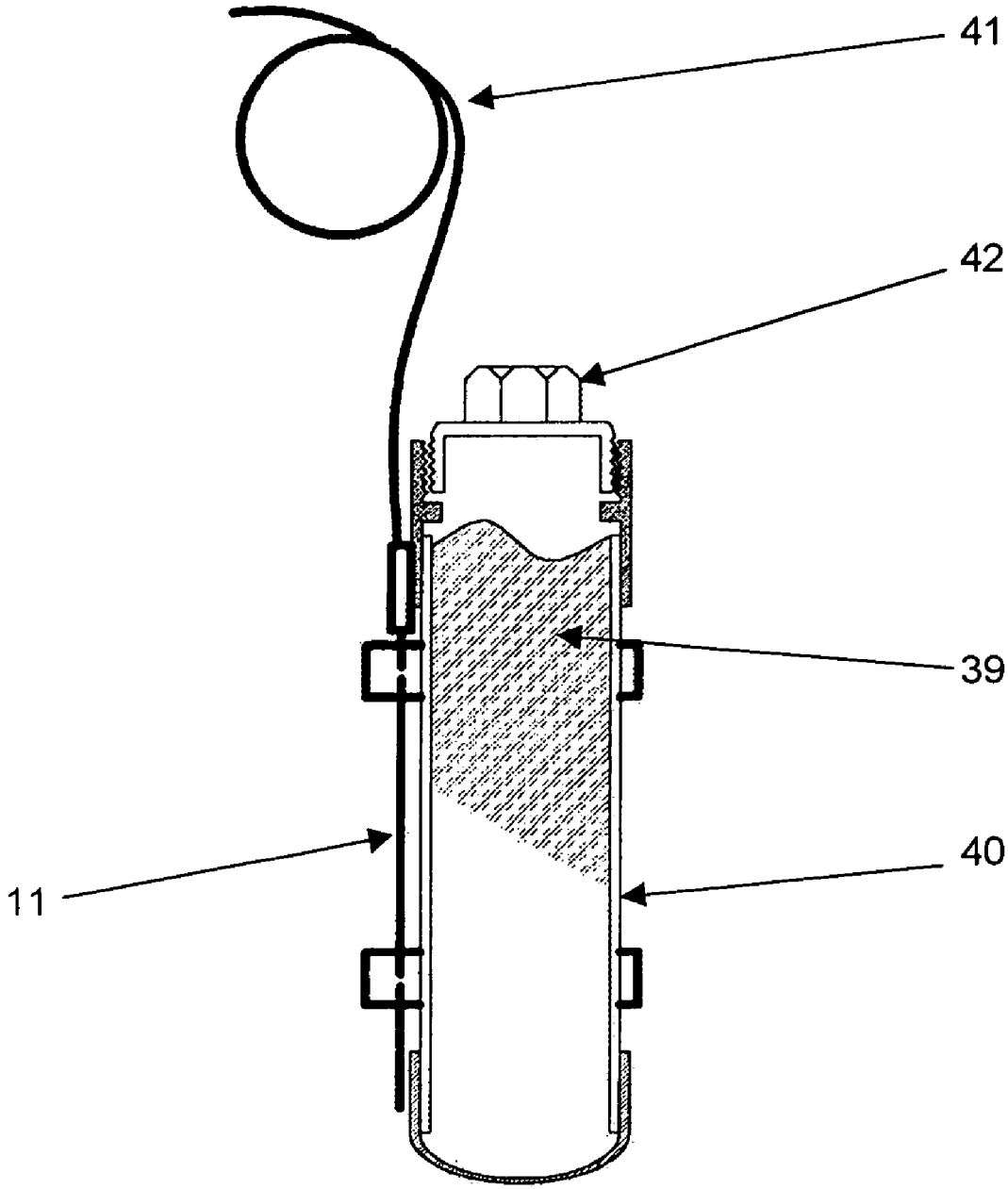
FIG. 8 shows preportioned container with specified quantity of backfill and specified wire anode and cable attached for shipment and placement in field according to another aspect of the invention.

FIG. 8 shows pre-portioned container 40 with specified quantity of backfill 39 and specified wire anode 11 and cable 41 attached for shipment and placement in field. The container has a removable cap 42 to allow reuse.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the description and claims appropriately interpreted by those skilled in the art.

What is claimed is:

1. An active cathodic protection system, for the protection of a non-isolated structure, comprising:

a consumable anode;

a rectifier element with at least one electrical connection to a source of electrical current, said rectifier element including a direct current positive (+) output terminal connected to said consumable anode, said anode connector and further including a direct current negative (−) output terminal connected to said non-isolated structure via a cathode connector;

an electrical safety grounding device for electrical safety grounding of said non-isolated structure; and anti-cross connection device for preventing the continuing flow of electrical current when said anode connector is associated with said negative output terminal and said cathode connector is associated with said positive output terminal.

2. The active cathodic protection system according to claim 1 wherein at least one of the anode connector and the cathode connector are elongated conductor connectors.

3. The cathodic protection system according to claim 1, wherein the anode is located at least partially underground.

4. The cathodic protection system of claim 3, wherein said anode is in the form of an anode bed and is regularly moistened by installing a drip-irrigation system to regularly dispense water on top of the anode bed installation.

5. The cathodic protection system according to claim 1, wherein said anti-cross connection means is a fuse located between a transformer associated with said rectifier and the negative output terminal of the system.

6. The cathodic protection system according to claim 5, wherein said fuse is associated with the direct current side of said transformer and rectifier element.

7. The cathodic protection system according to claim 5, wherein said fuse is associated with a warning lamp or light connected in parallel with said fuse, whereby when said fuse blows, said warning lamp is lit to notify users or operators of the system that said fuse has blown or a cross-connection has occurred.

8. The cathodic protection system according to claim 5, wherein said anti-cross connection device for preventing the continuing flow of electrical current comprises an electrical loop between a point in the system close to said negative output terminal, said electrical safety grounding device for safety grounding the system, the cathode connector lead, and an internal jumper wire, wherein, in a cross-connection situation, both output terminals of the transformer and rectifier element are connected to the same electrical safety grounding device for safety grounding the system, resulting in a short circuit of said fuse.

9. The cathodic protection system according to claim 8, wherein said electrical loop is a low resistance electrical loop.

10. The cathodic protection system according to claim 1, wherein said anti-cross connection device comprises a current directing diode.

11. The cathodic protection system according to claim 10, wherein said current directing diode is associated with said cathode connector.

12. The cathodic protection system of claim 1, comprising a cathodic protection system body, and a remotely installed plug-in type power supply module.

13. A method of transporting and installing an anode in a hole in the ground, comprising the steps of:

securely attaching said anode to a container;

filling said container with a predetermined amount of backfill material for a particular anode hole size;

transporting said container and said securely attached anode to potential hole site;

digging an anode hole corresponding to the amount of backfill material provided in said container;

removing said anode from said container;

placing said anode in said anode hole;

removing said predetermined amount of backfill from said container; and placing said predetermined amount of backfill from said container into said anode hole.

14. The method according to claim 13 wherein said container is reusable, having a screw-cap on a first end, and holding said predetermined quantity of backfill material.

15. The method according to claim 13 wherein said container includes a rigid tube with a removable end-cap that is made in a predetermined size to provide the amount of backfill that is required for the specified anode and hole size configuration, said rigid tube incorporating a handle and a strapping mechanism to attach the corresponding anode to said container holding the predetermined amount of backfill.

* * * * *